US009085925B2

(12) United States Patent
Steinhauser

(10) Patent No.: US 9,085,925 B2
(45) Date of Patent: Jul. 21, 2015

(54) SYNCHRONIZATION APPARATUS FOR MOVING FURNITURE PARTS

(71) Applicant: Julius Blum GmbH, Hoechst (AT)

(72) Inventor: Markus Steinhauser, Rankwell (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/205,515

(22) Filed: Mar. 12, 2014

(65) Prior Publication Data

US 2014/0191632 A1 Jul. 10, 2014

Related U.S. Application Data

(63) Continuation of application No. PCT/AT2012/000221, filed on Aug. 24, 2012.

(30) Foreign Application Priority Data

Sep. 20, 2011 (AT) ..... 1356/2011

(51) Int. Cl.
*E05D 15/46* (2006.01)
*E05D 15/40* (2006.01)
*A47B 95/00* (2006.01)

(52) U.S. Cl.
CPC ..... *E05D 15/46* (2013.01); *E05D 15/40* (2013.01); *A47B 2210/0064* (2013.01); (Continued)

(58) Field of Classification Search
CPC ..... A47B 88/08; A47B 88/10; A47B 88/12; A47B 88/14; A47B 2210/0059; A47B 2210/0032; A47B 2210/0064; A47B 2210/0067; A47B 2210/007; A47B 2210/0078; A47B 2210/0083; A47B 2210/17; A47B 2210/175; A47B 2210/0013
USPC ..... 312/331, 323, 322, 109, 110, 325, 326, 312/327, 294
See application file for complete search history.

(56) References Cited

U.S. PATENT DOCUMENTS 657,809 A * 9/1900 Beebe ..... 312/331
2,620,253 A * 12/1952 Read et al. ..... 312/331
(Continued)

FOREIGN PATENT DOCUMENTS

AT 508 959 5/2011
DE 202010010085 U1 * 10/2011 ..... A47B 88/04
(Continued)

OTHER PUBLICATIONS

International Search Report (ISR) issued Nov. 29, 2012 in International (PCT) Application No. PCT/AT2012/000221.
(Continued)

*Primary Examiner* — Daniel J Troy
*Assistant Examiner* — Andrew Roersma
(74) *Attorney, Agent, or Firm* — Wenderoth, Lind & Ponack, L.L.P.

(57) ABSTRACT

A synchronization apparatus has at least two actuating apparatuses for moving a movable furniture part, and has a synchronization rod for synchronizing the movement of the at least two actuating apparatuses. A first end region of the synchronization rod can be connected to a first rotary part of the first actuating apparatus, and a second end region of the synchronization rod can be connected to a second rotary part of the second actuating apparatus. At least one rotary part of the actuating apparatuses has a spring-loaded contact-pressure part which bears against the end face of the synchronization rod.

15 Claims, 9 Drawing Sheets

(52) U.S. Cl.
CPC ..... *A47B 2210/0078* (2013.01); *E05Y 2201/62* (2013.01); *E05Y 2201/706* (2013.01); *E05Y 2600/52* (2013.01); *E05Y 2900/20* (2013.01); *Y10T 29/49613* (2015.01)

(56) References Cited

U.S. PATENT DOCUMENTS

| | | | | | |
|---|---|---|---|---|---|
| 4,089,408 | A * | 5/1978 | Vanderhoof | ..... | 198/890.1 |
| 5,026,130 | A * | 6/1991 | Wright et al. | ..... | 312/323 |
| 5,335,987 | A * | 8/1994 | Hodge et al. | ..... | 312/323 |
| 5,582,489 | A | 12/1996 | Marzio et al. | | |
| 5,590,758 | A * | 1/1997 | Wilkins et al. | ..... | 198/890.1 |
| 6,698,258 | B2 * | 3/2004 | Westwinkel | ..... | 70/85 |
| 7,794,028 | B2 | 9/2010 | Brunnmayr | | |
| 2008/0054771 | A1 | 3/2008 | Brunnmayr | | |
| 2012/0038255 | A1 * | 2/2012 | Netzer et al. | ..... | 312/319.1 |
| 2012/0181909 | A1 | 7/2012 | Isele et al. | | |

FOREIGN PATENT DOCUMENTS

| | | | | | |
|---|---|---|---|---|---|
| EP | 2407056 | A1 * | 1/2012 | ..... | A47B 88/04 |
| GB | 2 391 257 | | 2/2004 | | |
| JP | 2006-294638 | | 10/2006 | | |
| WO | 2006/113953 | | 11/2006 | | |
| WO | WO2009114885 | A1 * | 9/2009 | ..... | A47B 88/04 |
| WO | WO2010129971 | A1 * | 11/2010 | ..... | A47B 88/04 |
| WO | 2011/047396 | | 4/2011 | | |

OTHER PUBLICATIONS

Austrian Patent Office Search Report (ASR) issued May 9, 2012 in Austrian Patent Application No. A 1356/2011.

* cited by examiner

SYNCHRONIZATION APPARATUS FOR MOVING FURNITURE PARTS

BACKGROUND OF THE INVENTION

The present invention concerns a synchronization apparatus having at least two actuating devices for moving a moveable furniture part and a synchronization rod for synchronizing the movement of the at least two actuating devices. A first end region of the synchronization rod can be connected to a first rotary portion of the first actuating device, and a second end region of the synchronization rod can be connected to a second rotary portion of the second actuating device.

In addition, the invention concerns an article of furniture having at least one synchronization apparatus of the kind to be described and a method of mounting a synchronization rod which is provided for synchronization of a movement of two actuating devices to be mounted in or to an article of furniture.

WO 2006/113953 A1 to the present applicant describes a synchronization apparatus of the general kind set forth, wherein two actuating devices each have a rotatably mounted portion, which portions can be non-rotatably connected together by way of a synchronization rod. In a first mounting step, the two actuating devices are pre-mounted in an article of furniture, in a subsequent mounting step the synchronization rod can be connected to the pre-mounted rotatable portions of the actuating devices. The synchronization rod can provide for a synchronous rotary movement of the two actuating devices and thus a harmonic movement of a moveable furniture part. For making the non-rotatable connection to the rotatable portions, the synchronization rod has a non-circular cross-section received in a corresponding recess in the rotatable portions. That requires additional machining of the synchronization rod.

SUMMARY OF THE INVENTION

An object of the present invention is to provide a synchronization apparatus of the general kind set forth in the opening part of the specification, while avoiding the above-mentioned disadvantage. The aim is to permit easy assembly and play-free connection of the synchronization rod relative to the two rotary portions.

According to the invention, it is therefore provided that at least one rotary portion of the actuating devices has a spring-loaded pressure portion bearing against the end of the synchronization rod.

The spring-loaded pressure portion produces a contact pressure force to hold the synchronization rod in a biased play-free condition between the two opposite rotary portions of the two actuating devices with a predetermined holding force in a direction extending in the longitudinal direction of the synchronization rod, wherein a comparatively weak spring being in principle sufficient for that purpose.

For transmission of the torque between the two rotary portions of the actuating devices disposed in opposite relationship on the article of furniture, the spring-loaded pressure portion can engage in positively locking relationship into a recess deviating from a circular shape in the end of the synchronization rod. In that respect, at least one end region of the synchronization rod can have a non-circular cross-section, and the rotary portion of the actuating device can have a receiving sleeve adapted at least portion-wise to the outside contour of the end region of the synchronization rod.

In a possible configuration of the invention, the receiving sleeve or at least the bottom of the receiving sleeve, that bears against the front face of the synchronization rod, can be in the form of a spring-loaded pressure portion. In principle, it can be sufficient if the spring-loaded pressure portion is formed in one piece by the end of a spring.

Arranging a spring-loaded pressure portion on a rotary portion of the actuating device has several advantages. More specifically, the synchronization rod can be adapted to be invariable in length. It is preferably provided that the synchronization rod is of the same cross-section over the entire length, and it is particularly preferably provided that the synchronization rod is in the form of a hollow profile member of the same inside diameter over the entire length.

In other words, the synchronization rod can be formed for example from a simple extruded profile member of metal—for example aluminum—which is individually cut to the appropriate length on site. In that way, it is possible to provide for optimum compensation of the tolerances occurring. In that respect, it is possible to completely dispense with any additional machining of that profile member.

The article of furniture according to the invention is characterized by at least one synchronization apparatus of the kind in question. In that case, the two actuating devices can be provided for moving a furniture flap mounted moveably in respect of height relative to a furniture carcass. It can, however, also be possible for the two actuating devices to be adapted to move a drawer which is supported displaceably relative to a furniture carcass, for example for stabilizing the running characteristic thereof to prevent lateral tilting of the drawer relative to a furniture carcass.

In principle, the synchronization apparatus can be used wherever a rotary movement of two actuating devices is to be synchronized, for example therefore also for synchronously triggering so-called Touch-Latch devices for ejecting moveable furniture parts from the closed end position. That Touch-Latch function makes it possible to eject moveable furniture parts by a manual pressing or pulling applied on the moveable furniture part.

The method according to the invention of mounting a synchronization rod which is provided for synchronization of a movement of two actuating devices to be mounted in or to an article of furniture. The actuating devices respectively have a rotary portion for the movement of a moveable furniture part. The two actuating devices are mounted in or to an article of furniture, and the synchronization rod is pressed inclinedly relative to a notional connecting line (X) between the rotary portions of the actuating devices against a spring-loaded pressure portion of a rotary portion. The synchronization rod is pivoted into the notional connecting line (X), and then, under a spring action, the spring-loaded pressure portion is pushed towards the oppositely disposed rotary portion and non-rotatably connected thereto by way of the synchronization rod.

BRIEF DESCRIPTION OF THE DRAWINGS

Further details and advantages of the invention will be described by reference to the specific description hereinafter. In the drawings.

DETAILED DESCRIPTION OF THE INVENTION

Figure 1A:
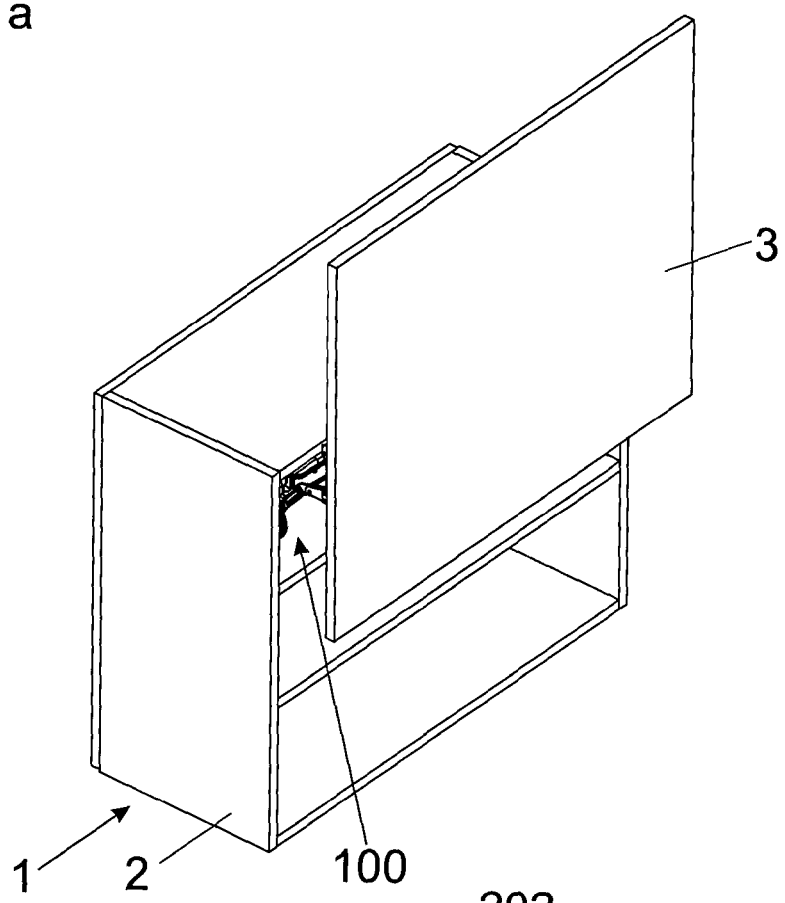
FIGS. 1*a* and 1*b* are perspective views of an article of furniture with a furniture flap moveable in respect of height and the synchronization apparatus to be mounted to the article of furniture.
Figure 1B:
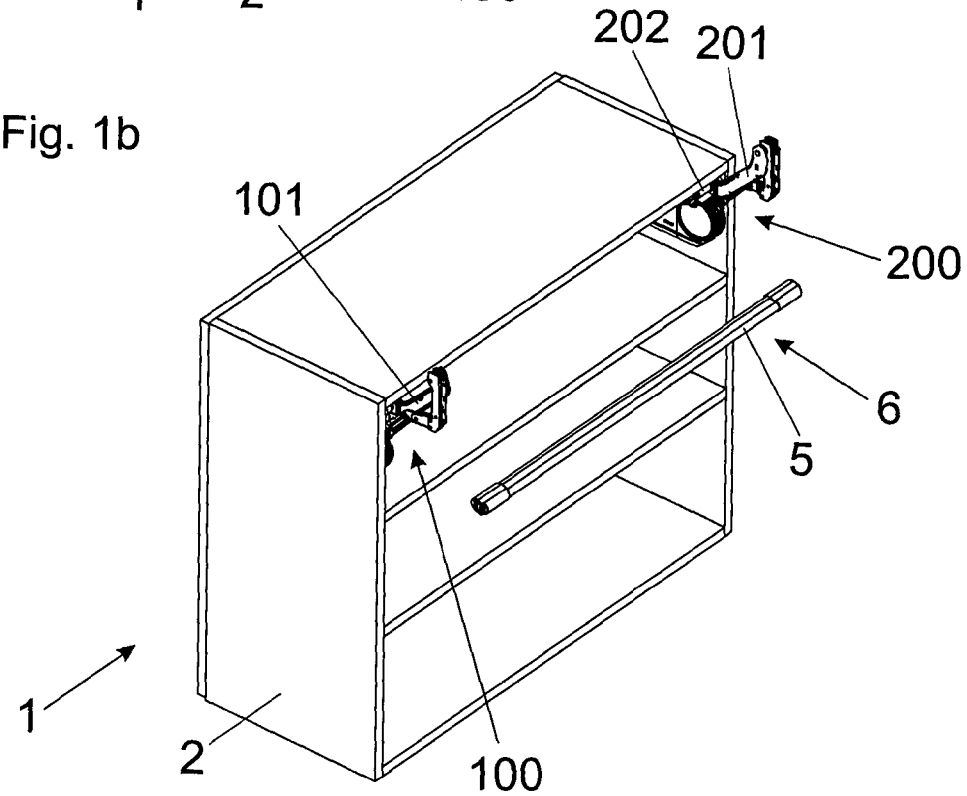

FIG. 1*a* shows an article of furniture 1 having a furniture carcass 2 and a flap 3 which is mounted moveably in respect of height relative to the furniture carcass 2 by way of actuating devices 100, 200. The flap 3 is removed from the view in FIG. 1 *b* so that the actuating devices 100, 200 mounted at opposite side walls are visible. The two actuating devices 100, 200 together with a synchronization rod 5 form a synchronization apparatus 6 for moving the flap 3. In the illustrated embodiment, the two actuating devices 100, 200 respectively have at least one actuating arm 101, 201 pivotable preferably about a horizontal axis, respectively to be connected to the flap 3. A respective rotary portion 102, 202 is motionally coupled to the actuating arms 101, 202, but the rotary portion 102 of the left-hand actuating device 100 is not visible in FIG. 1*b*. The synchronization rod 5 which is in the form of a torsion shaft is provided for synchronization of the movement of the two actuating devices 100, 200 so that coupled synchronous rotary movement of the two rotary portions 102, 202 is also produced. Preferably, the synchronization rod 5 extends substantially horizontally in the position of use.

Figure 2A:
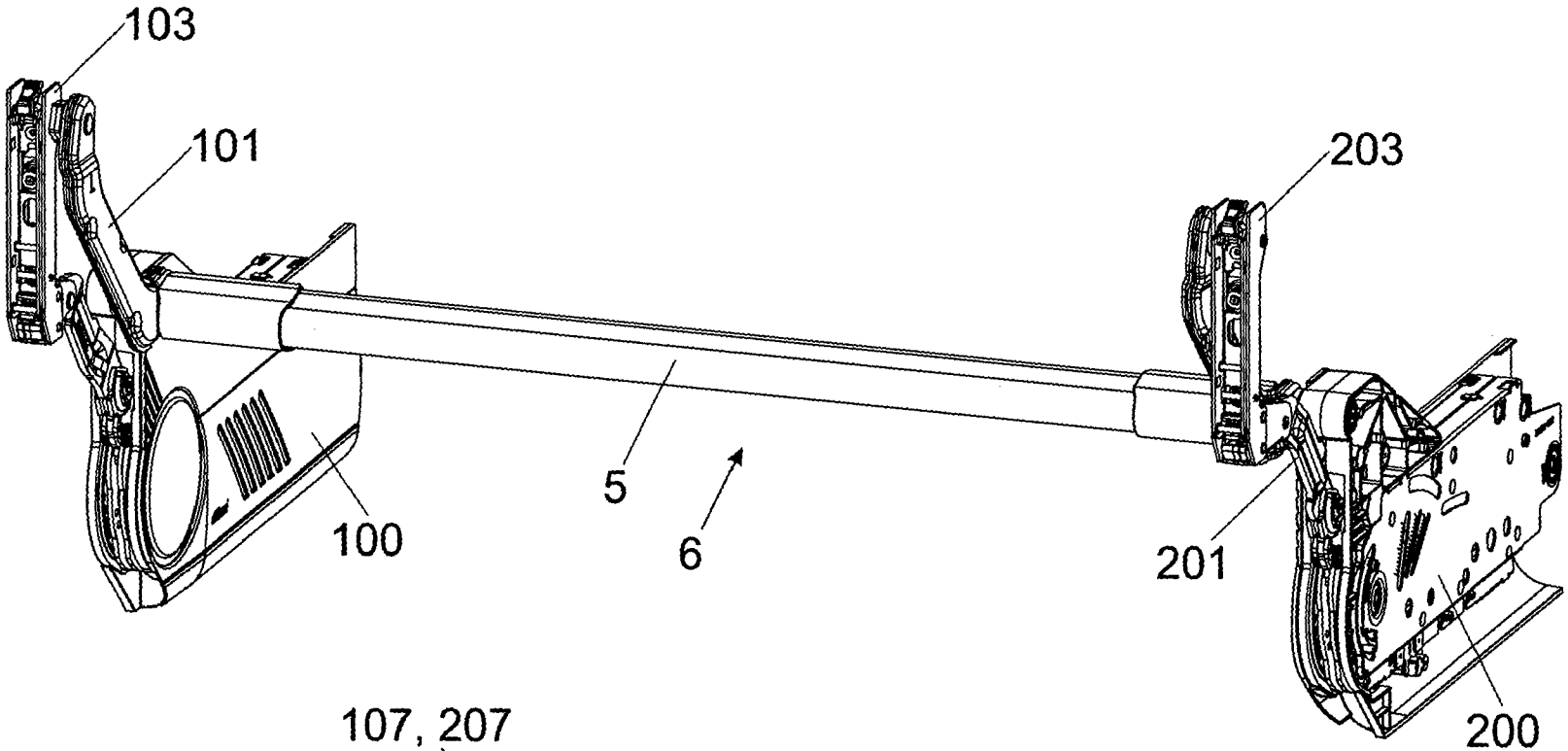
FIGS. 2*a* and 2*b* are a perspective view of an embodiment of a synchronization apparatus and a view of a pressure portion with an end region of the synchronization rod.

FIG. 2*a* shows a perspective view of the synchronization apparatus 6, wherein the two actuating devices 100, 200 are to be fixed at mutually opposite sides in or to an article of furniture 1. The actuating devices 100, 200 respectively have spring devices (not visible here) which are provided to pressurize the actuating arms 101, 201 towards the opening direction and thus to compensate for the weight of the flap 3. At least one of the actuating devices 100, 200 can also have an electric motor for driving an actuating arm 101, 201, as an alternative or in addition to a spring device. The pivotal movement of the two actuating arms 101, 201 can be synchronized by the synchronization rod 5. Arranged on the actuating arms 101, 201 are respective fitment portions 103, 203 which are to be respectively connected to the flap 3.

FIG. 2*a* shows a perspective view of a spring-loaded pressure portion 107, 207 with an end region of the synchronization rod 5. In the assembled condition, the pressure portion 107, 207 engages with the projections 111, 211 into recesses 7, 8 differing from a circular shape in the front face of the synchronization rod 5. The illustrated construction makes it possible to provide a reliable positively locking connection for the transmission of torque.

Figure 2B:
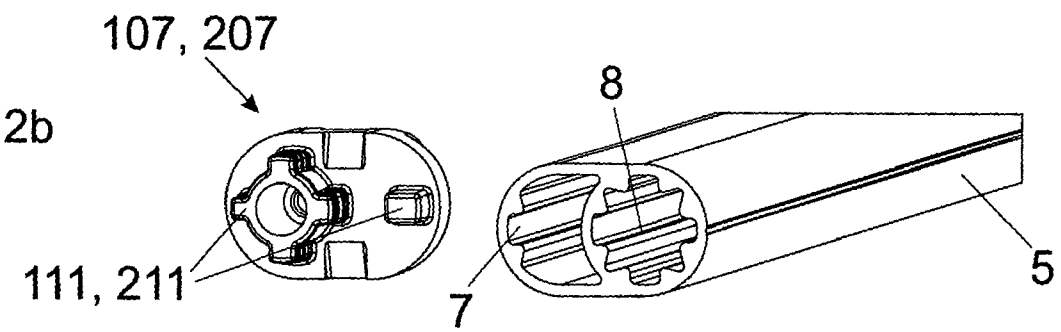
Figure 3A:
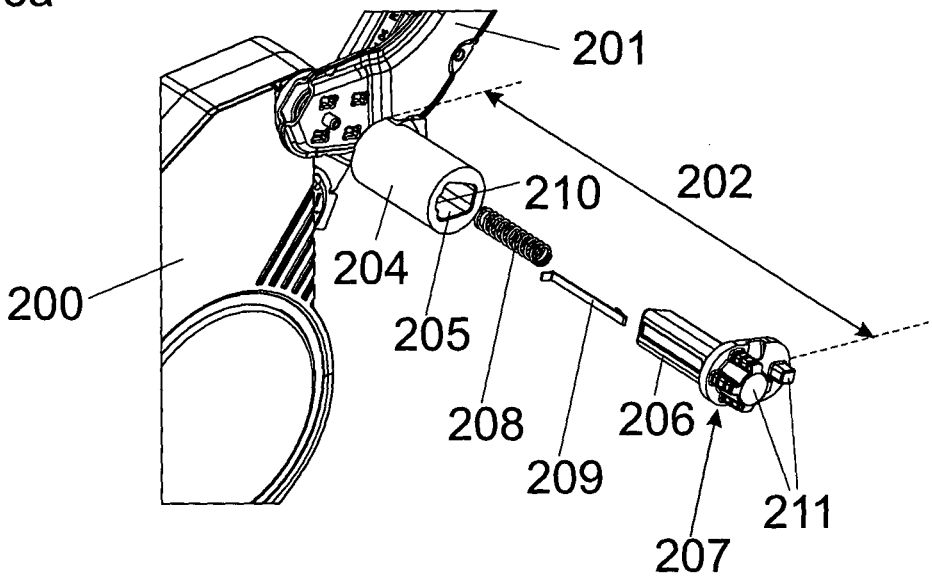
FIGS. 3*a*-3*c* are various views of the rotary portion of an actuating device.

FIG. 3*a* shows an exploded view of part of the actuating device 200 with the actuating arm 201 pivotably mounted thereto. Connected to the actuating arm 201 is a rotary portion 202, so the rotary portion 202 also rotates upon a pivotal movement of the actuating arm 201. The rotary portion 202 includes a receiving sleeve 204 with a non-circular opening 205 provided to receive a shaft 206 of a corresponding spring-loaded pressure portion 207. The spring-loaded pressure portion 207 is biased with respect to the receiving sleeve 204 by a spring 208 so that the pressure portion 207 is limitedly displaceable between two end positions in a direction extending in the longitudinal direction of the synchronization rod 5. The pressure portion 207 projects beyond the receiving sleeve 204 in the rest position and can be pressed axially into the receiving sleeve 204 in opposition to the spring action. A holding element 209 is operative between the pressure portion 207 and the receiving sleeve 204, and the holding element 209 limits the outward extension movement of the pressure portion 207 relative to the receiving sleeve 204 so that the pressure portion 207 is not pressed completely out of the receiving sleeve 204 by the force of the spring 208. The holding element 209 is arranged in a groove 210 in the receiving sleeve 204, and at its end regions has projections which engage, on the one hand, between the actuating arm 201 and the receiving sleeve 204 and, on the other hand, on the spring-loaded pressure portion 207. The pressure portion 207 is provided with projections 211 which, in the assembled position, engage into a recess 7, 8 (FIG. 2*b*) differing from a circular shape, in the end of the synchronization rod 5.

Figure 3B:
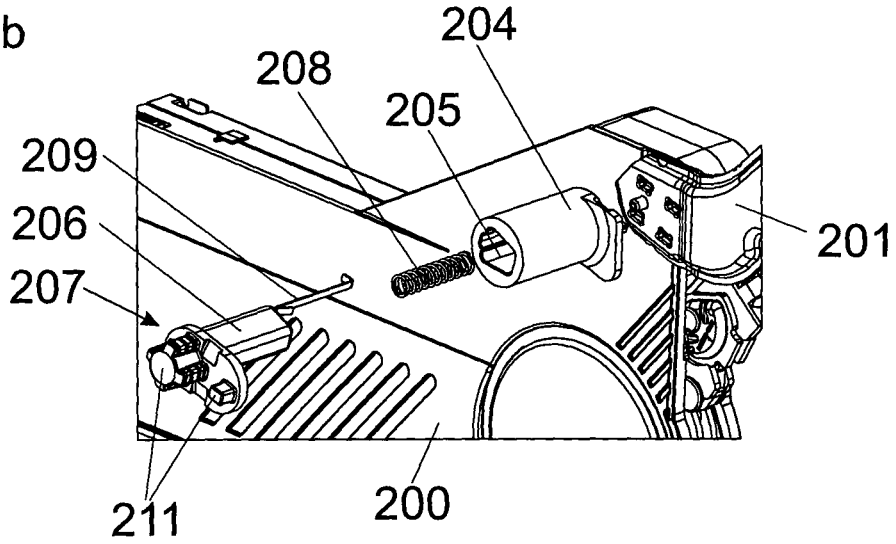
Figure 3C:
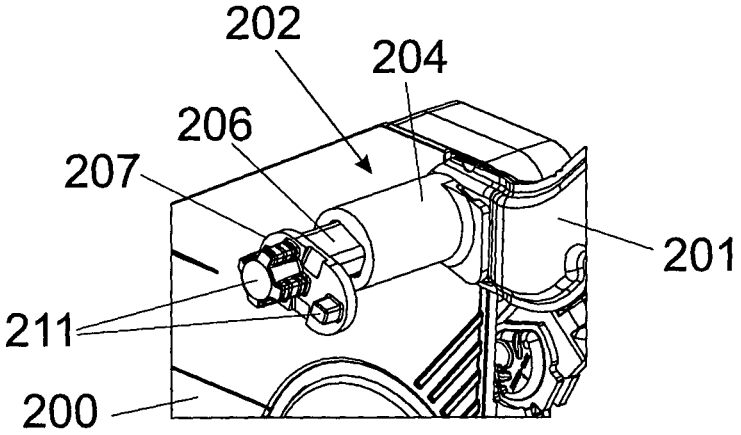

FIG. 3*b* shows another perspective view of the portion shown in FIG. 3*a*, the pressure portion 207 being connected to the holding element 209. FIG. 3*c* shows the mounted position of the rotary portion 202, in which the shaft 206 of the pressure portion 207 is mounted displaceably within the receiving sleeve 204 and projects beyond the same. Starting from that position, the pressure portion 207 can be pressed into the receiving sleeve 204 in opposition to the force of the spring 208. FIG. 3*c* shows the delivery condition of the rotary portion 202 from the factory.

Figure 4:
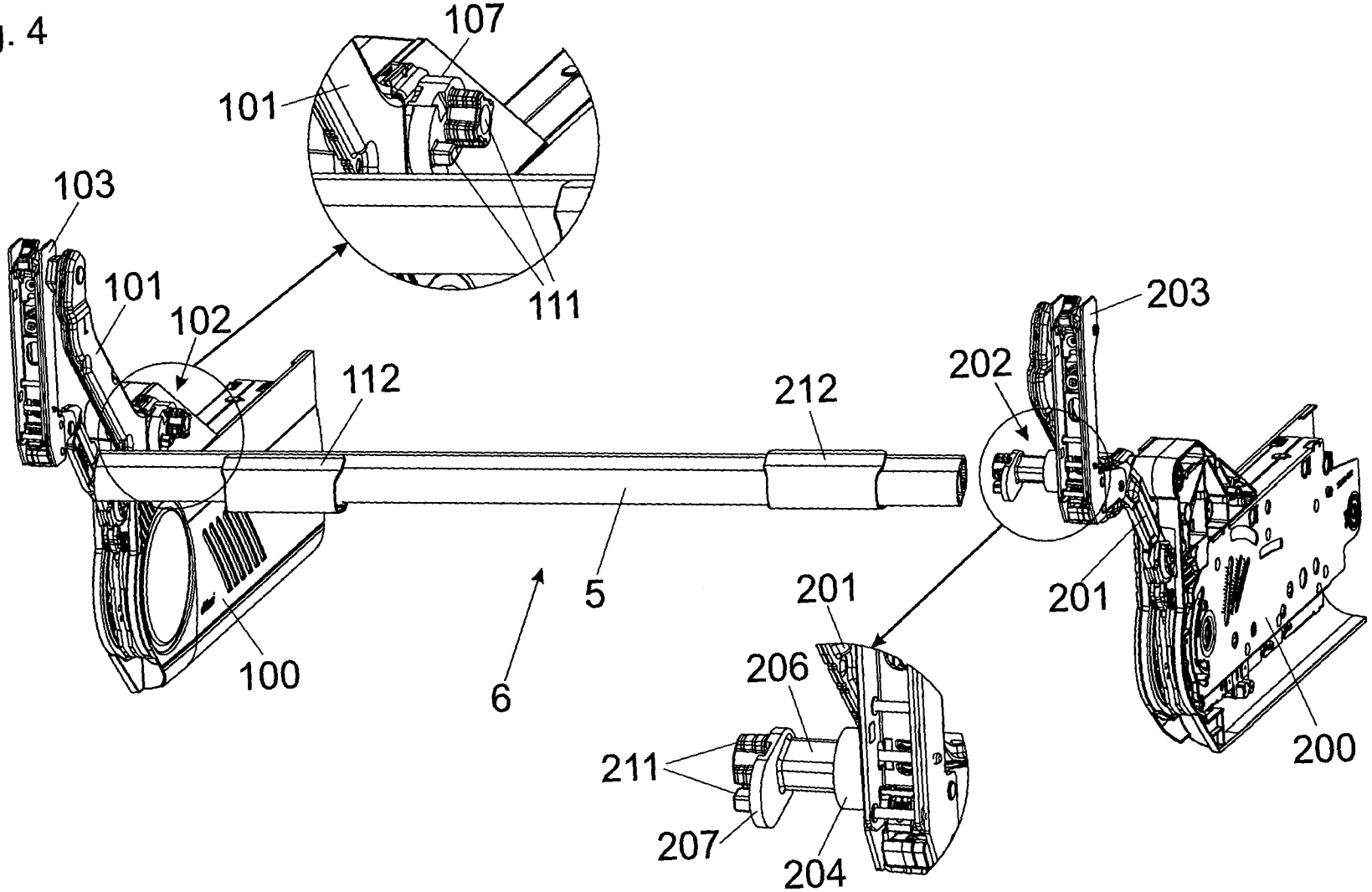
FIGS. 4-7 show mounting of the synchronization rod in successive mounting steps.

FIG. 4 shows the synchronization apparatus 6 with the two actuating devices 100, 200 which are to be fixed to an article of furniture 1 in a first mounting step. The enlarged view shows the two rotary portions 102, 202 of the actuating devices 100, 200 respectively. Mounting of the synchronization rod 5 is also possible when the two actuating devices 100, 200 are already pre-mounted to the article of furniture 1, with the rotary portions 102, 202. In the illustrated embodiment, the rotary portion 102 of the left-hand actuating device 100 has a non-sprung (not spring-loaded) pressure portion 107 while the rotary portion 202 of the right-hand actuating device 200 is provided with a spring-loaded pressure portion 207 which can be pushed in with the shaft 206 in the direction of the receiving sleeve 204 so that the internal spacing between the two rotary portions 102, 202 can be temporarily increased by pushing in the spring-loaded pressure portion 207. Cover portions 112, 212 are displaceably mounted to the synchronization rod 5, and after mounting of the synchronization rod 5 has been effected, the cover portions 112, 212 can be positioned over the pressure portions 107, 207.

Figure 5:
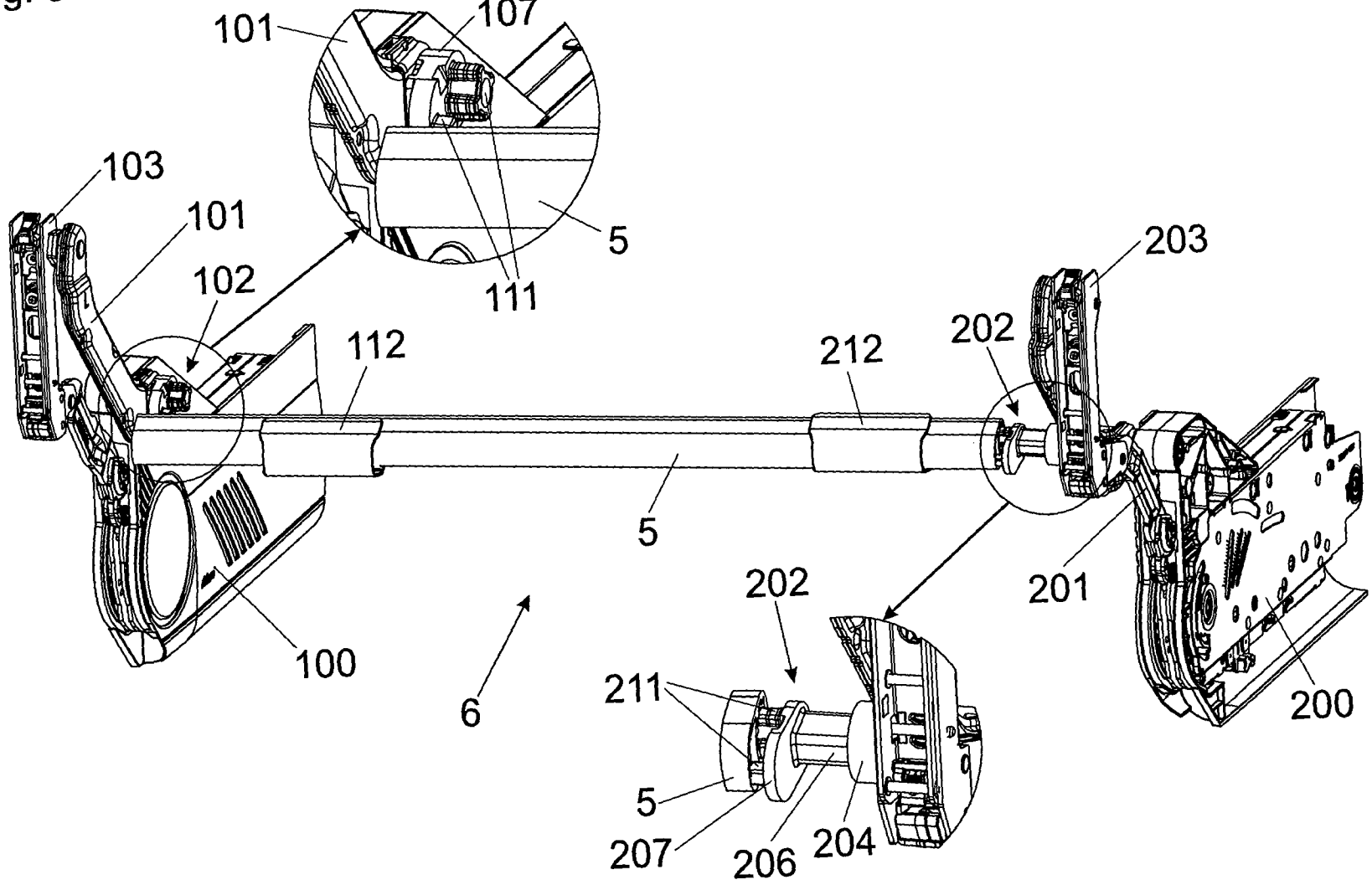

FIG. 5 shows the further mounting procedure for the synchronization rod 5 which can be slightly inclinedly pushed with the right-hand end region on to the two projections 211 of the spring-loaded pressure portion 207. The left-hand end region of the synchronization rod 5 is initially not yet connected to the non-sprung pressure portion 107.

Figure 6:
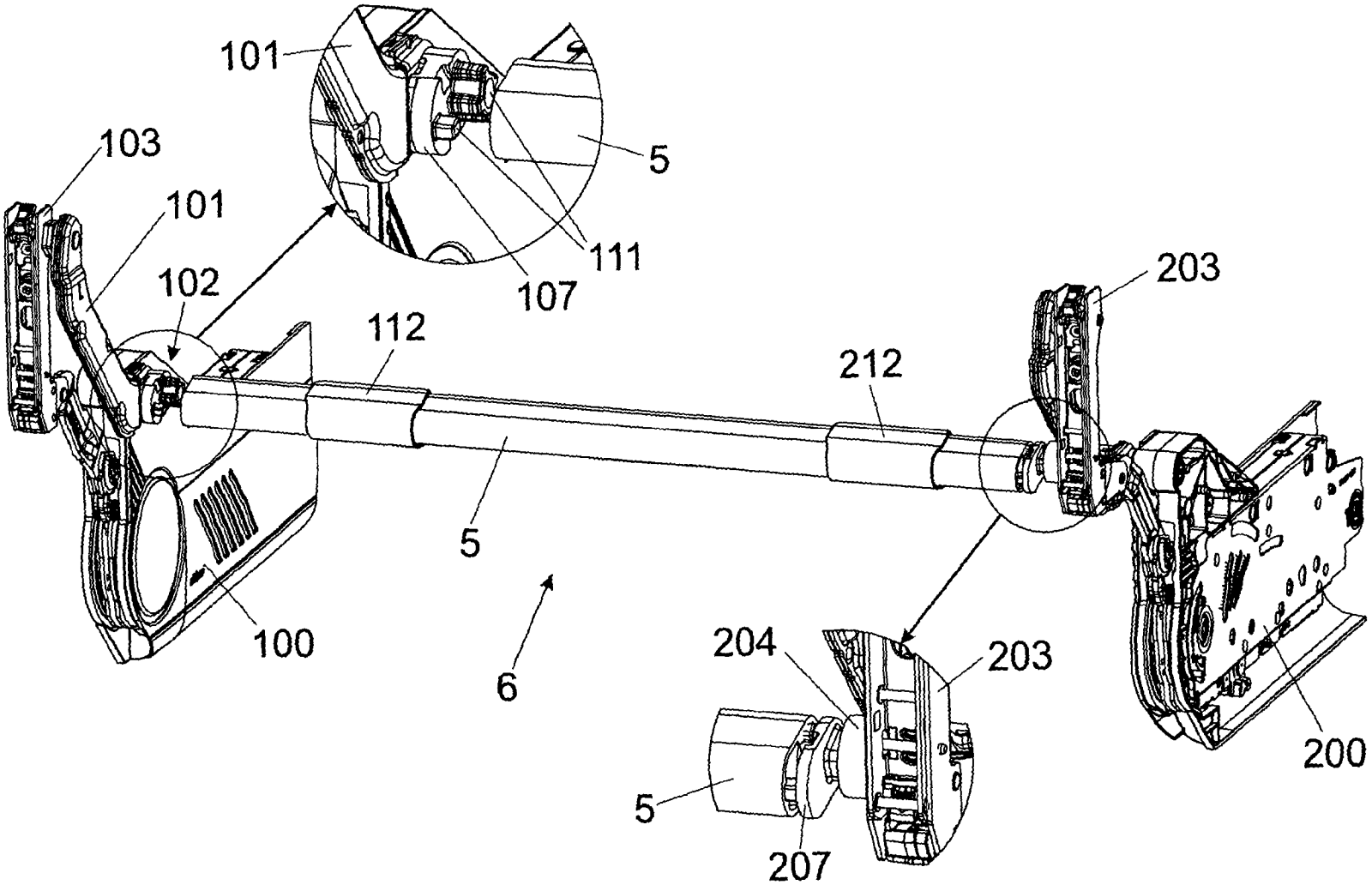

FIG. 6 shows a subsequent mounting step, wherein the right-hand spring-loaded pressure portion 207 can be pushed by a predetermined travel distance into the receiving sleeve 204 against the force of the spring 208 by manually applying pressure to the synchronization rod 5. The synchronization rod 5 is now disposed on the notional connecting line between the two rotary portions 102, 202 of the two actuating devices 100, 200.

Figure 7:
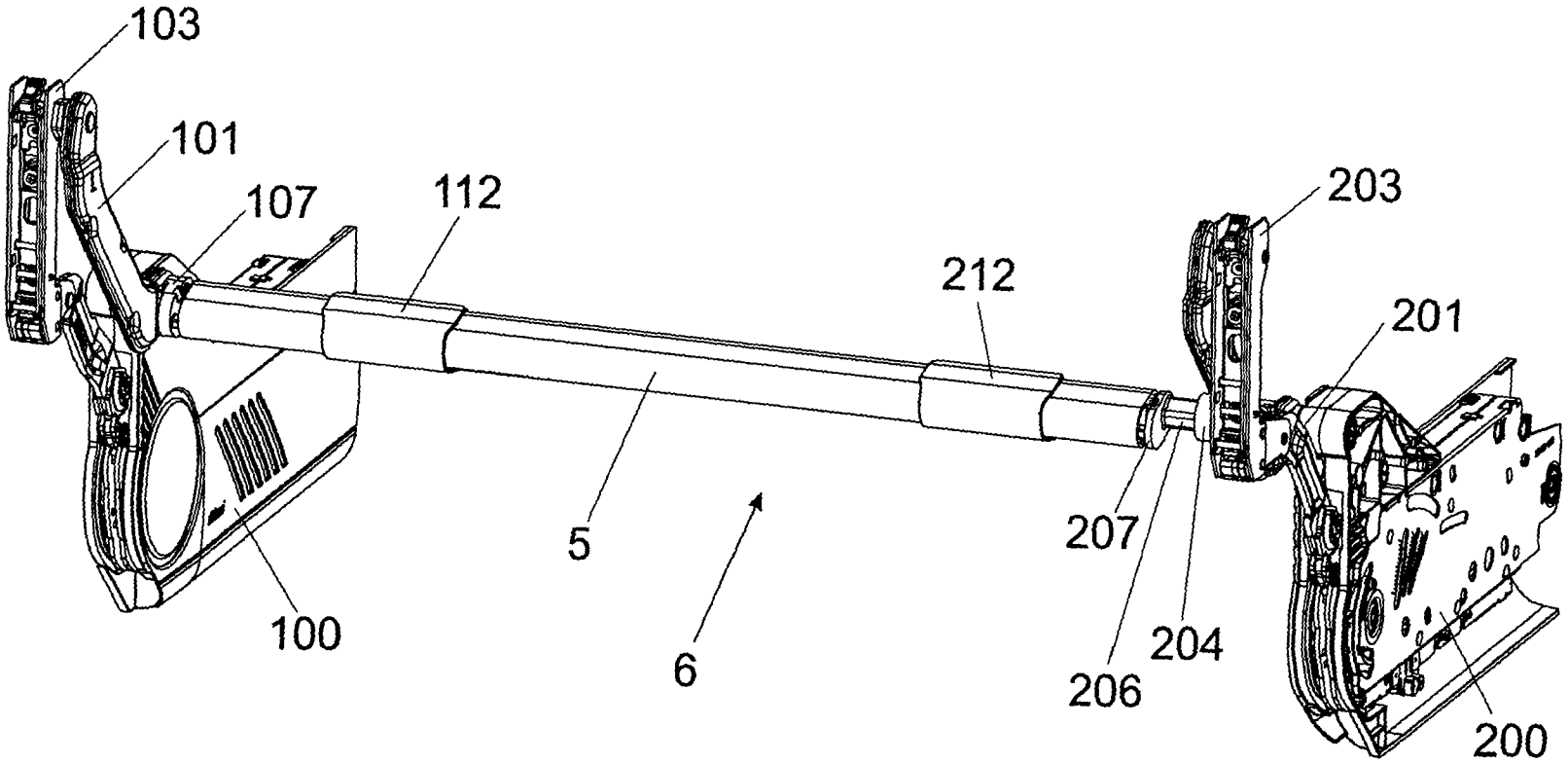

FIG. 7 shows the synchronization rod 5 connected to the pressure portions 107, 207. Now, starting from FIG. 6, pressure is no longer applied to the synchronization rod 5 by the fitter, whereupon the spring-loaded pressure portion 207 with the shaft 206 moves out again due to the expanding spring 208 so that the left-hand end of the synchronization rod 5 is pushed on to the projections 111 of the right-hand non-sprung (not spring-loaded) pressure portion 107. The movement of the two actuating arms 101, 201 is now synchronized by a positively locking relationship. The two cover portions 112, 212 can then be pushed onto the two pressure portions 107 and 207.

Figures 8A, 8B, 8C, 8D:
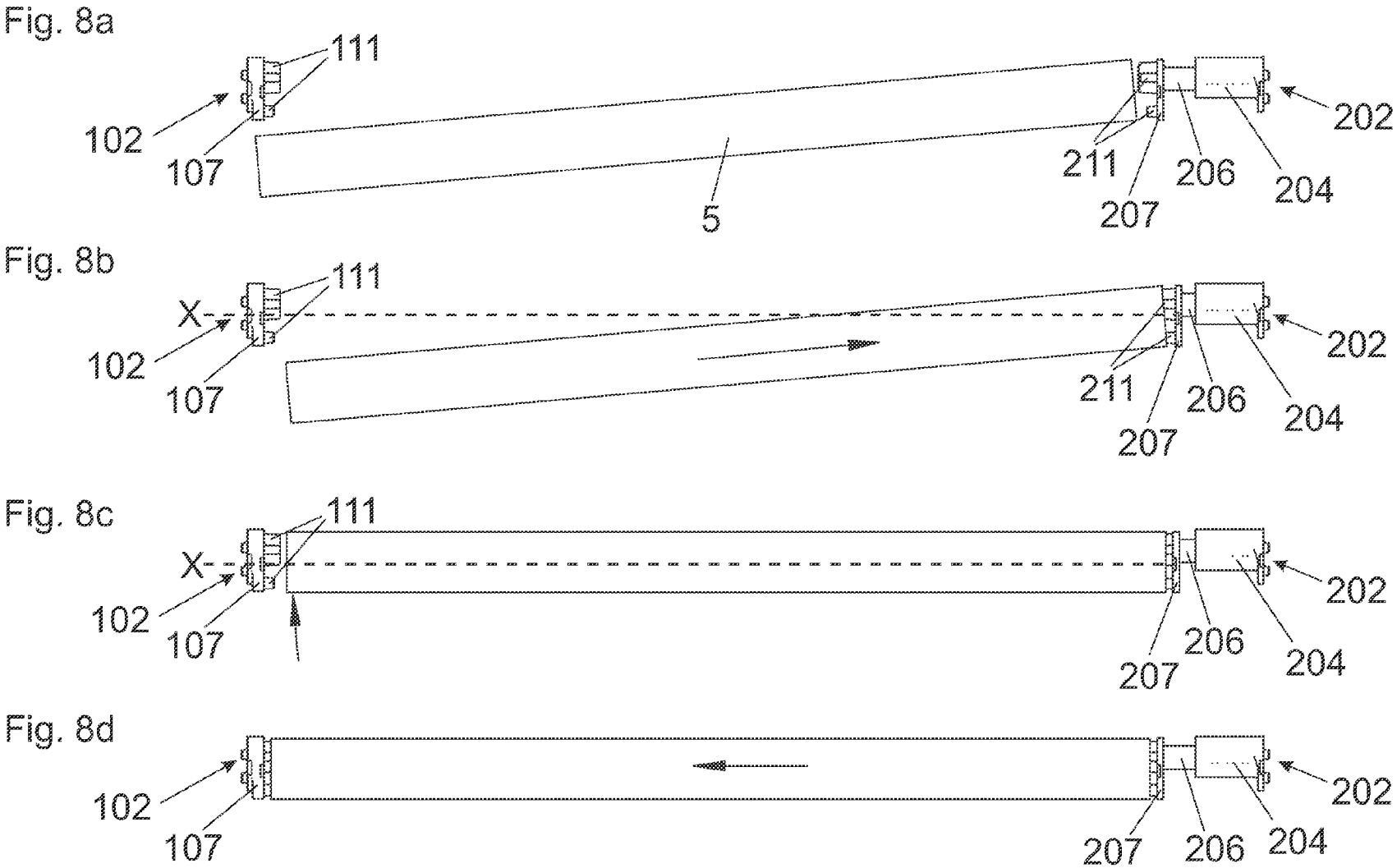
FIGS. 8*a*-8*d* are diagrammatic views illustrating mounting of the synchronization rod relative to the rotary portions of the actuating devices.

FIGS. 8*a*-8*c* show highly diagrammatic views illustrating mounting of the synchronization rod 5 relative to the two rotary portions 102, 202 of the two oppositely disposed actuating devices 100, 200. As shown in FIG. 8*a*, the two actuating devices 100, 200 are pre-mounted with their rotary portions 102, 202 to an article of furniture 1, whereupon the synchronization rod 5 is pressed inclinedly relative to a notional connecting line (X) between the rotary portions 102, 202 against the spring-loaded pressure portion 207 of the right-hand rotary portion 202, in which case the projections 211 of the spring-loaded pressure portion 207 are received in the hollow profile member of the synchronization rod 5. In FIG. 8*b*, the synchronization rod 5 is pressed manually in the direction indicated by the arrow, in which case the pressure portion 207 with the shaft 206 is pressed against the spring force in the direction of the receiving sleeve 204. As shown in FIG. 8*c*, the synchronization rod 5 is pivoted into the notional connecting line (X) between the two rotary portions 201, 202. As shown in FIG. 8*d*, the synchronization rod 5 is displaced towards the left in the direction indicated by the arrow by the expanding spring 208 (FIG. 3*a*), in which case the projections 111 of the left-hand non-sprung pressure portion 107 engage into the end of the synchronization rod 5.

Figures 9A, 9B, 9C, 9D:
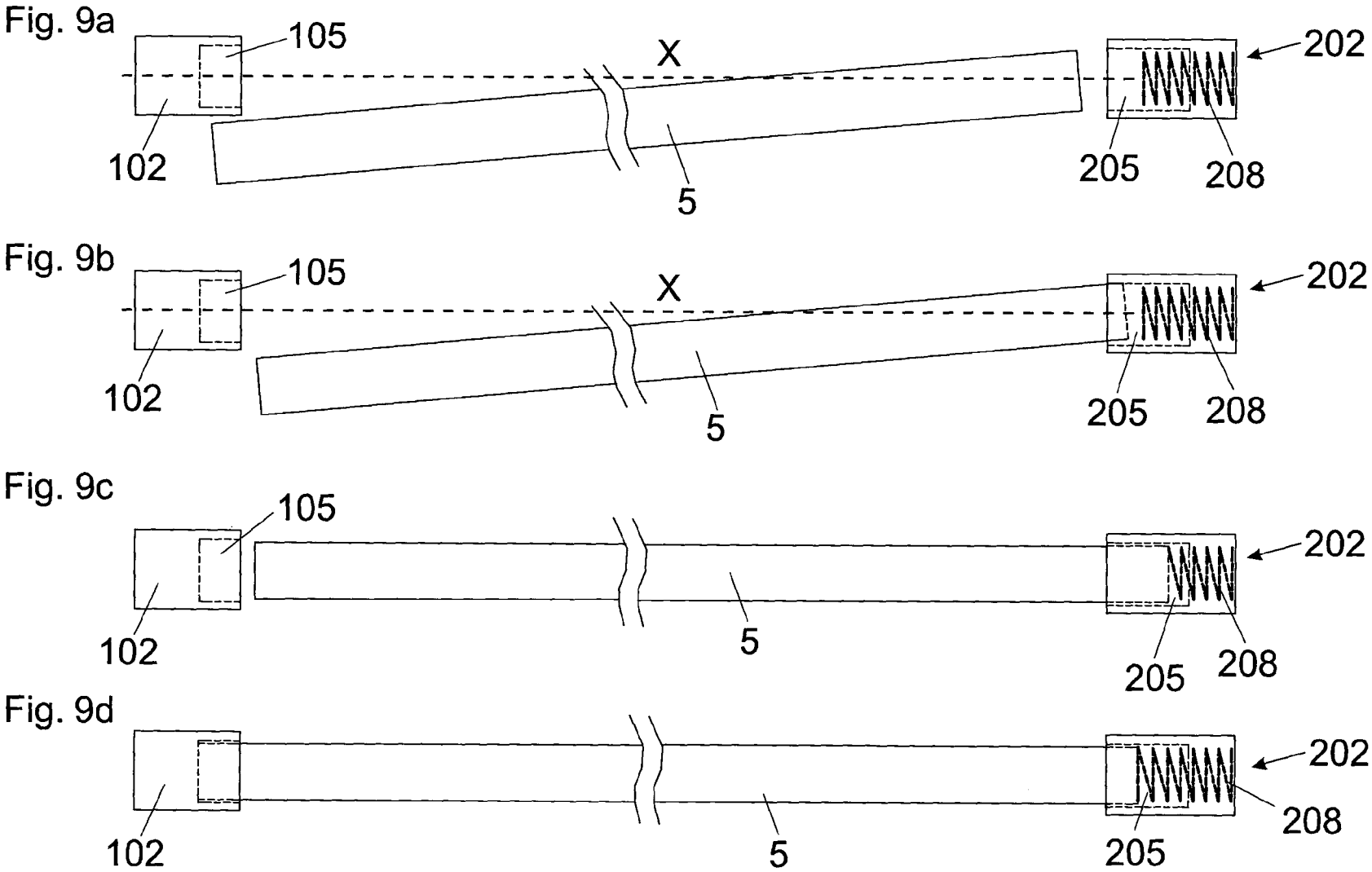
FIGS. 9*a*-9*d* show mounting of the synchronization rod to rotary portions in a simplified embodiment.

FIGS. 9*a*-9*d* also show highly diagrammatic forms of a simplified embodiment of the rotary portions 201, 202 of the actuating devices 100, 200. The left-hand rotary portion 102 has an opening 105, preferably of non-circular cross-section, while a spring 208 is mounted in the opening 205 of the right-hand rotary portion 202. Referring to FIG. 9*a*, the rotary portions 102, 202 are already pre-mounted to an article of furniture 1, whereupon the synchronization rod 5 is pressed inclinedly relative to a notional connecting line (X) between the two rotary portions 201, 202 against a spring-loaded pressure portion 207 of the rotary portion 202. In the illustrated embodiment, the spring-loaded pressure portion 207 of the rotary portion 202 is formed in one piece by the end of the spring 208, the synchronization rod 5 being pushed into the opening 205 by manually applying pressure (FIG. 9*b*). As shown in FIG. 9*c*, the synchronization rod 5 was pivoted into the notional connecting line (X), the spring 208 being compressed while the manual force is maintained. The manual pressure is now removed from the synchronization rod 5 so that the left-hand end region of the synchronization rod 5 can move into the opening 105 provided in the left-hand rotary portion 102 due to expansion of the spring 208 and the synchronization rod 5 is held in a play-free manner between the two rotary portions 102, 202. Transmission of the torque can be effected by way of a positively locking connection, as already described above.

The present invention is not limited to the illustrated embodiments but includes or extends to all variants and technical equivalents which can fall within the scope of the appended claims. The positional references adopted in the description such as, for example, up, down, left, right and so forth are also related to the directly described and illustrated Figure and are to be appropriately transferred to the new position upon a change in position. It is preferable that the pressure portion 207 is pre-mounted to or in the article of furniture 1 and is motionally coupled to the actuating arm 201 so that, upon a pivotal movement of the actuating arm 201, the pressure portion 207 also rotates therewith, in which case then the synchronization rod 5 can be connected to the pressure portion 207 which is already pre-mounted. For easy mounting of the synchronization rod 5, the rotary portion 202 to which the pressure portion 207 is fitted can preferably be mounted rotatably exclusively about an axis of rotation.

The invention claimed is:

1. A synchronization apparatus comprising:

a first actuating device including a first rotary portion;

a second actuating device including a second rotary portion, said first actuating device and said second actuating device being configured to move a moveable furniture part; and a synchronization rod for synchronizing movement of said first actuating device and said second actuating device, said synchronization rod having a first end region to be connected to said first rotary portion of said first actuating device, said synchronization rod having a second end region to be connected to said second rotary portion of said second actuating device;

wherein at least one of said first rotary portion and said second rotatory portion includes a spring-loaded pressure portion for bearing against a respective end of said synchronization rod; and wherein each of said first rotary portion and said second rotary portion is integrally formed as a unit with a respective one of said first actuating device and said second actuating device such that, during absence of said synchronization rod, said first rotary portion, said second rotary portion, and said spring-loaded pressure portion remain connected to a respective one of said first actuating device and said second actuating device; wherein said at least one of said first rotary portion and said second rotatory portion including said spring-loaded pressure portion further includes a receiving sleeve and a holding element operative between said spring-loaded pressure portion and said receiving sleeve, said holding element being configured to limit and outward extension movement of said spring-loaded pressure portion relative to said receiving sleeve; wherein said holding element has opposed first and second end regions, each of said first and second end regions including a projection for engaging said receiving sleeve and said pressure portion, respectively.

2. The synchronization apparatus according to claim 1, wherein said spring-loaded pressure portion engages in a positive-locking relationship into a non-circular recess in said respective end of said synchronization rod.

3. The synchronization apparatus according to claim 2, wherein at least one of said first end region and said second end region of said synchronization rod has a non-circular cross-section, and a respective one of said first rotary portion and said second rotary portion has a receiving sleeve with at least a portion shaped to correspond to an outer contour of said at least one of said first end region and said second end region of said synchronization rod.

4. The synchronization apparatus according to claim 3, wherein at least a bottom portion of said receiving sleeve is configured to bear against said at least one of said first end region and said second end region of said synchronization rod, and said at least a bottom portion of said receiving sleeve is formed as said spring-loaded pressure portion.

5. The synchronization apparatus according to claim 1, wherein said spring-loaded pressure portion is formed in one piece by an end of a spring.

6. The synchronization apparatus according to claim 1, wherein said synchronization rod is invariable in length and has a uniform cross-section over an entire length of said synchronization rod, and said synchronization rod is formed as a hollow profile member having a uniform inside diameter over the entire length of said synchronization rod.

7. The synchronization apparatus according to claim 1, wherein said spring-loaded pressure portion is configured to be displaceably mounted between two end positions relative to said at least one of said first rotary portion and said second rotatory portion along a longitudinal direction of said synchronization rod.

8. The synchronization apparatus according to claim 1, wherein at least one of said first rotary portion and said second rotary portion has a receiving sleeve, said spring-loaded pressure portion being supported in said receiving sleeve and projecting beyond an end of said receiving sleeve.

9. The synchronization apparatus according to claim 8, wherein said spring-loaded pressure portion is biased by a spring relative to said receiving sleeve.

10. The synchronization apparatus according to claim 1, wherein said synchronization rod is configured to be connected to said first rotary portion of said first actuating device and said second rotary portion of said second actuating device after said first actuating device and said second actuating device have been mounted to an article of furniture.

11. The synchronization apparatus according to claim 1, wherein said synchronization rod is non-rotatably connected to said first rotary portion of said first actuating device and said second rotary portion of said second actuating device in an assembled condition.

12. An article of furniture comprising:

a moveable furniture part; and a synchronization apparatus according to claim 1 for synchronizing a movement of said moveable furniture part.

13. The article of furniture according to claim 12, further comprising a furniture carcass, wherein said moveable furniture part is a furniture flap mounted to be moveable upwardly relative to said furniture carcass by said first actuating device and said second actuating device of said synchronization apparatus.

14. The article of furniture according to claim 12, further comprising a furniture carcass, wherein said moveable furniture part is a drawer mounted to be displaceable relative to said furniture carcass by said first actuating device and said second actuating device of said synchronization apparatus.

15. A method of mounting a synchronization rod for synchronizing movement of two actuating devices to be mounted to an article of furniture, each of the two actuating devices having a respective rotary portion for moving a moveable furniture part, at least one respective rotary portion of the two actuating devices including an integral spring-loaded pressure portion; wherein said at least one respective rotary portion including said integral spring-loaded pressure portion further includes a receiving sleeve and a holding element operative between said spring-loaded pressure portion and said receiving sleeve, said holding element being configured to limit and outward extension movement of said spring-loaded pressure portion relative to said receiving sleeve; wherein said holding element has opposed first and second end regions, each of said first and second end regions including a projection for engaging said receiving sleeve and said pressure portion, respectively, said method comprising:

mounting the two actuating devices each having the respective rotary portion to the article of furniture in an opposing manner;

after said mounting, pressing the synchronization rod at an incline relative to a notional connecting line (X) between the respective rotary portions of the two actuating devices towards a first one of the two actuating devices against a spring force of the spring-loaded pressure portion of the rotary portion of the first one of the two actuating devices;

pivoting the synchronization rod toward the notional connecting line (X); and then releasing a pressure against the spring force of the spring-loaded pressure portion to allow the spring-loaded pressure portion to be pushed towards an opposing second one of the two actuating devices so as to thereby non-rotatably connect the synchronization rod to the two actuating devices.

* * * * *